US009629409B1

(12) United States Patent
Cannon, Jr. et al.

(10) Patent No.: US 9,629,409 B1
(45) Date of Patent: Apr. 25, 2017

(54) METHOD AND APPARATUS FOR PREVENTING CONCUSSIONS

(71) Applicants: Thomas Calvin Cannon, Jr., Las Vegas, NV (US); Marc James Cannon, Las Vegas, NV (US)

(72) Inventors: Thomas Calvin Cannon, Jr., Las Vegas, NV (US); Marc James Cannon, Las Vegas, NV (US)

( * ) Notice: Subject to any disclaimer, the term of this patent is extended or adjusted under 35 U.S.C. 154(b) by 0 days.

(21) Appl. No.: 15/156,537

(22) Filed: May 17, 2016

(51) Int. Cl.
*A42B 3/00* (2006.01)
*A42B 3/06* (2006.01)
*A63B 71/10* (2006.01)

(52) U.S. Cl.
CPC ..... *A42B 3/062* (2013.01); *A63B 71/10* (2013.01)

(58) Field of Classification Search
CPC ..... A42B 3/062; A42B 3/0406; A42B 3/04; A43B 3/00; A43B 3/003; A43B 3/069; A63B 71/10
USPC ..... 2/411, 425, 6.6, 410, 412
See application file for complete search history.

(56) References Cited

U.S. PATENT DOCUMENTS 3,128,095 A * 4/1964 Sharkey ..... A63B 21/065 2/171.2
3,174,155 A * 3/1965 Pitman ..... A42B 3/069 2/411
3,435,460 A * 4/1969 Grant ..... A42B 3/06 2/422
3,789,427 A * 2/1974 Aileo ..... F41H 1/08 2/423
4,660,230 A * 4/1987 Mayling ..... A42B 3/069 2/413
4,843,642 A * 7/1989 Brower ..... A42B 3/125 2/414
4,937,888 A * 7/1990 Straus ..... A42B 3/003 2/411
5,996,126 A * 12/1999 Barthold ..... A42B 3/14 2/410
6,282,724 B1 * 9/2001 Abraham ..... A41D 13/015 2/267
6,314,586 B1 * 11/2001 Duguid ..... A42B 3/069 2/411
6,625,820 B1 * 9/2003 Lampe ..... A42B 3/00 2/171
D608,057 S * 1/2010 Zagar ..... D30/112
7,722,301 B2 * 5/2010 Rosenblum ..... A63B 22/18 2/425
8,826,468 B2 * 9/2014 Harris ..... A42B 3/127 2/411

(Continued)

*Primary Examiner* — Clinton T Ostrup
*Assistant Examiner* — Jillian K Pierorazio

(57) ABSTRACT

A method and apparatus for mitigating concussions resulting from sharp blows to protective headgear. The method consists of attaching cushioning pads to the outside of the headgear, held in place by straps and anchors. The apparatus consists of substantially flat flexible pads, which are made to conform to any helmet by the pressure exerted by the straps wrapping around the curved helmet. The anchors consist of clips and hooks that attach the straps to features of the helmet such as holes, edges, and protrusions. The main pad is a strip that runs over the crown of the helmet, from front to back, making the helmet to resemble a "Mohawk" haircut. Optional side pads protect the sides of the helmet. All apparatus can be repeatedly installed and removed without using special tools.

2 Claims, 5 Drawing Sheets

(56) References Cited

U.S. PATENT DOCUMENTS

| | | | | |
|---|---|---|---|---|
| 9,232,827 | B1 * | 1/2016 | Penn | A61F 5/05891 |
| 2011/0113529 | A1 * | 5/2011 | Milioto | A42B 1/24<br>2/209.13 |
| 2011/0179557 | A1 * | 7/2011 | Rabie | A63B 71/10<br>2/411 |
| 2011/0225708 | A1 * | 9/2011 | Polstein | A42B 3/205<br>2/425 |
| 2012/0151663 | A1 * | 6/2012 | Rumbaugh | A42B 3/065<br>2/411 |
| 2013/0031700 | A1 * | 2/2013 | Wacter | A42B 3/322<br>2/411 |

* cited by examiner

METHOD AND APPARATUS FOR PREVENTING CONCUSSIONS

This invention relates to preventing head concussions resulting from sharp blows to the head. More specifically, this invention relates to modifying headgear in a way that prevents concussions that routinely occur in contact sports, such as football, and in other activities wherein a person's head might strike a hard object. Approximately 3.6 million individuals in the United States of America play football (comprising two thousand professionals, 12 thousand college students, 1.1 million high school students and 2.5 million youths). The very best current-day headgear is incapable of preventing their concussions, as acknowledged by the statement printed on each helmet sold: "WARNING: No helmet can prevent serious head or neck injuries a player might receive while playing football. Do not use this helmet to butt, ram or spear an opposing player. This is in violation of the football rules and such use can result in severe head and neck injuries, paralysis or death to you and possible injury to your opponent. Contact in football may result in CONCUSSION-BRAIN INJURY which no helmet can prevent." Thus there is a compelling need to advance the state of the art in headgear technology to better protect the large number of participants in football and other sports.

The issue of providing better headgear has as much to do with affordability as it does with technology. The best present-day football helmets typically cost over $300 each. Incorporating additional injury-prevention technology into existing helmets could increase their cost to the point where helmets are unaffordable for most participants. Accordingly, to be successful, the incremental cost of safer helmet technology must be minimal. Further, the capital investments that institutions have made in their existing helmet inventories should be preserved, to the extent possible, to promote adoption of safer technology. Therefore, an ideal solution would be to greatly improve the effectiveness of all existing helmets while minimizing additional cost. This is a considerable challenge because of the ranges of different helmet designs and sizes.

The present invention provides a method for enhancing all existing helmets to greatly reduce the incidence of concussions, using low-cost apparatus that may be installed, and removed, entirely by hand. The key is to augment existing helmets with an external cushioning system engineered to absorb large impacts that would otherwise cause concussions.

BACKGROUND OF THE INVENTION

The U.S. Centers for Disease Control and Prevention estimates that 300,000 sports-related concussions occur yearly in the U.S., but that number includes only athletes who lost consciousness. Since loss of consciousness is thought to occur in less than 10% of concussions, the actual number is probably closer to 3 million a year. Further, half of these concussions occur in children age 0 to 14, and an addition 38% occur in the age group 15 to 34. Only recently has the extent of sports-related mild traumatic brain injury (MTBI) become known among the general public. However, individuals and organizations concerned with protecting sports participants have pursued better protective headgear since the early 1940s. Such efforts have mostly focused on improving the cushioning inside the helmet's hard plastic shell. However, to date, no helmet has been able to completely eliminate concussions.

The laws of Physics limit the effectiveness of internal cushioning because of the limited space insides helmets. Current day football helmets weigh approximately four pounds and contain air cushioning that's approximately one inch thick. The helmets fit over athletes' heads, weighing an average of 11 pounds. A sharp blow that causes a 100 g acceleration (g being the acceleration of gravity, or 32.2 feet/sec$^2$) of the helmet cannot be reduced to a safe level with just one inch of padding. Further, the force delivered to the head can be amplified during "rebound" conditions. Such conditions occur when the athlete's head is already moving in the direction of the force applied to the helmet, as what happens when the helmet bounces off the ground. This is what occurred in 1960 when Philadelphia Eagle Chuk Bednarik tackled NY Giant Frank Gifford, causing a lifelong head injury that caused Frank Gifford to miss the entire next professional football season. Concussions resulting from head collisions are now being treated as a serious issue.

Most concussion studies have focused on measuring head accelerations rather than devising ways of reducing accelerations. Companies and organizations have developed small accelerometers that players may ware to record the accelerations (linear and rotational) experienced during contact. Such data is useful in determining the acceleration levels that produce concussions, currently believed to be between 100 g and 150 g.

The National Operating Committee on Standards for Athletic Equipment (NOCSAE) has meticulously developed methodologies to test the ability of football headgear to limit head accelerations. Their principal test for football helmets consists of dropping a helmeted Headform (i.e. simulated head) onto a half inch thick polyurethane pad that measures the deceleration of the helmeted Headform. The tests prescribe a variety of impact velocities with the helmet oriented in different positions. Further, the NOCSAE has developed a measure of the severity of impacts, called the Severity Index (SI). The SI is defined as the integral of the acceleration raised to the 2.5 power, measured over the interval when the acceleration rises above 4 g, and drops back below 4 g. Mathematically, this becomes:

$$SI = \int_{t_1}^{t_2} A^{2.5} dt$$

where A is the instantaneous acceleration, expressed as a multiple of the gravitational acceleration, g.

The NOCSAE prescribes limits on SI as a function of impact speed and point of impact on the helmet. As such, the Severity Index provides an objective measure of the protective value of helmets. For example, NOCSAE prescribes that the SI of a 17.94 foot/sec impact shall not exceed 1200 for any helmet impact orientation.

While prior designs that only employ cushioning material on the inside of the helmet can meet NOCSAE requirements, they cannot guarantee protection against concussions. Accordingly, investigators have looked at adding cushioning material on the outside of the helmet. In particular, Alfred Pettersen (US Patent 20150000013A1) invented an exterior sport helmet pad that was formed to fit over the helmet, and was held in place by internal contact pressure. Although such a cushioning device may provide some additional protection, it would be prohibitively expensive because a separate mold would be required for each size of each helmet design. Further, covering the entire outer surface of the helmet with extra padding could make the helmet excessively heavy, and thereby adversely affect athletic performance. In addition, Pettersen's conclusion that a pad thickness of only 0.5 to 0.75 inches thick was sufficient to mitigate concussions was unfounded because his tests did not conform to NOCSAE specifications. In particular, Pettersen's top impact speed was 8.97 feet/sec, which is below the prescribed NOCSAE minimum test speed of 11.34 feet/sec, and well below the NOCSAE maximum test speed of 17.94 feet/sec. Finally, Pettersen did not report the Severity Index for any test (as required by NOCSAE), but rather reported the amount that his external padding reduced the peak acceleration. Although Pettersen described the NOCSAE helmet tests within his patent, he gave no indication that any such tests were actually performed as specified.

An analytical model of the dynamics governing helmet impact can help methodically design a cushioning system capable of inhibiting concussions. Analytical models not only reveal the key parameters for optimizing helmet performance, but also enable the calculation of key performance metrics, such as the Severity Index, for example. Accordingly, an analytical model is presented within this document that reveals how accelerations and deformations are related to impact velocity and the geometry and properties of the cushioning materials. Further the model yields optimum values for padding thickness and stiffness, and provides quantitative estimates of the associated SI values. This system of equations can be used by future investigators to optimize helmet performance under various conditions.

A pad of cushioning material may be modeled as a spring, having an effective spring constant, $K_e$ (pounds/foot). $K_e$ is the force, F (pounds), divided by the amount, 6 (feet), that the pad is compressed. Mathematically:

$$K_e = \frac{F}{\delta}$$

Also, according to Newton's Second Law, force equals mass times acceleration. Mathematically:

$$F = Ma$$

Combining these two equations to eliminate F yields an equation for acceleration in terms of displacement:

$$a = \delta\left(\frac{K_e}{M}\right)$$

The spring constant, $K_e$, is a function of the pad's elastic modulus, E (pounds/square inch), contact area, "Area" (square inches), and thickness, L (feet). Hence:

$$K_e = \frac{(\text{Area})E}{L}$$

Combining the above two equations yields the required elastic modulus, $E_{req}$, to arrest a particular acceleration:

$$E_{req} = \frac{L}{\delta}\frac{M}{(\text{Area})}a$$

For example, for a mass, M, consisting of a head weighing 11 pounds, and a helmet weighing 4 pounds, the Elastic Modulus required to arrest a 100 g acceleration, using a one-inch thick pad, 4 inches in diameter, and compressed to half its thickness is given by:

$$E_{req} = \frac{(1/12)}{(1/24)}\frac{(11+4)}{(4\pi)}100 = 238.7 \text{ psi}$$

The corresponding maximum force exerted on the helmet would equal Mass times acceleration or 1500 pounds (100 g×15#/g).

We can determine the impact velocity, $V_{Imp}$, required to produce a 100 g acceleration by using the conservation of energy principal. For an inelastic collision, with a coefficient of restitution, $\epsilon$, between the colliding bodies, we can equate the Potential Energy to the Kinetic Energy, less the energy lost in the collision. The Coefficient of Restoration, $\epsilon$, accounts for the energy dissipated in the collision. Hence we have:

$$\frac{K_e\delta^2}{2} = \frac{(M_s + M_h + M_p)(\varepsilon V_{Imp})^2}{2}$$

where $M_s$, $M_h$, and $M_p$ are the masses of the shell, head, and pad, respectively. Collectively, these masses equal the total mass, $M_t$. Solving for $V_{Imp}$ yields $$V_{Imp} = \frac{\delta}{\varepsilon}\sqrt{\frac{K_e}{M_t}}$$

However, the maximum linear acceleration is not the sole determinant of injury level—the variation of that acceleration with time also influences the severity of an impact. This time variation for a simple spring-mass system is given by:

$$a = V_{Imp}\varepsilon\sqrt{\frac{K_e}{M_t}}\sin\left(\sqrt{\frac{K_e}{M_t}}\,t\right) = V_{Imp}\varepsilon\omega\sin(\omega t),$$

where $$\omega \equiv \sqrt{\frac{K_e}{M_t}}$$

We can now substitute this equation for acceleration into the SI equation to estimate the severity of collisions. Since the SI equation has an acceleration exponent of 2.5, a precise calculation of SI requires a numerical integration. However, a reasonable analytical approximation for SI may be obtained by integrating $A^2$ instead of $A^{2.5}$, and raising the result of the integration to a power of 1.25 (2×1.25=2.5). This produces a number that is typically 5% greater than the integral of $A^{2.5}$. Hence the results should be multiplied by a factor of 0.95. Thus an approximate value of SI is given by:

$$SI \cong 0.95\left(\int_{t1}^{t2} A^2 dt\right)^{1.25}$$

where $t_1$ is the time when the acceleration first reaches 4 g, and $t_2$ is the time when the acceleration decays back down to 4 g. For our sine function, $t_2=\pi/\omega-t_1$. Carrying out the integration yields the following equation for estimating SI $$SI \cong 0.95[0.5\omega(\epsilon V_{Imp}/g)^2(\sin(2\beta)+\pi-2\beta)]^{1.25}$$

where $$\beta \equiv \text{ARCSIN}\left(\frac{4\ g}{\omega\varepsilon V_{Imp}}\right)$$

Substituting the numbers used in the example calculation of E yields the following tabulation of Severity Index versus impact velocity:

| | | | | |
|---|---|---|---|---|
| $V_{Imp}$ (ft/sec) | 11.34 | 13.89 | 16.04 | 17.94 |
| $\omega$ = SQRT($K_s$/($M_s$ + $M_h$)) (radians) | 279.02 | 279.02 | 279.02 | 279.02 |
| $\beta$ = ARCSIN(4 g/($\omega\epsilon V_{Imp}$)) (radians) | 0.082 | 0.067 | 0.058 | 0.051 |
| Calculated Severity Index (SI) | 24.78 | 41.15 | 58.98 | 78.02 |
| NOCSAE SI Limits | 300.00 | 1200.00 | 1200.00 | 1200.00 |

The calculated SI values are at least an order of magnitude below the NOCSAE limits. Further, when tested, the actual SI values will be reduced from the calculated values because of the cushioning inside the helmet. Accordingly, we can relax the example requirement on E by approximately a factor of two to 120 psi, and still have a quite viable concussion mitigation configuration. An E value of 120 psi is well within the softness of commonly available soft rubbers, such as neoprene and silicone. Polymer foam and sponge materials are also commonly available that have elastic moduli in this range. For example, Saint-Gobain's CORHlastic® 300/9030 Silicone solid rubber has an E value of 225 psi, and the company's firm sponge rubber has an E value of 111 psi.

It should be pointed out that there is some evidence that rotational accelerations of the head also play a role in concussions. However, the external cushioning system that mitigates linear accelerations should also mitigate rotational accelerations.

Since we have established that soft rubber pads affixed to the outside of helmets are capable of mitigating injuries, the issue now becomes how to best attach such cushioning material to headgear. There are three ways of attaching cushions to helmets: gluing (or bonding); form-fitting; or mechanically anchoring. Gluing or bonding pads to the outside of helmets is problematic for several reasons. First, it is difficult to get a planar-shaped pad to conform to a three-dimensional ellipsoidal-shaped helmet. Forcing such conformance creates high residual stresses in both the bonding interface and the pad material itself that will break over time. Second, sharp blows can dislodge glued pads from the helmet. Third, gluing is a time-consuming and craft-sensitive operation which would add considerable cost to externally padded helmets.

Form-fitting also has three major disadvantages. First, it would be prohibitively expensive to build custom molds for all existing and future helmet designs, and for all head sizes, because the lowest quotes for molds to produce such products are well over a thousand dollars. Also, the material cost of a full helmet cap is roughly three times the cost of a single four-inch wide strip covering just the crown of the helmet. Second, covering the entire outer surface of the helmet with material thick enough to appreciably reduce impact forces would add excessive weight that could adversely affect athletic activities. Finally, a fully conforming helmet cover would create an environment between the pad and the helmet that is conducive for the growth of mold, bacteria, and other pathogens that could be harmful to the user.

For the above reasons, the best choice is to mechanically anchor padding material to headgear. However, such anchoring must be done without employing hard protruding objects, such as brackets and buckles, which can pose injury risks. Also, the mechanical mechanism must keep the pads securely attached to the helmet through environmental extremes (temperature and humidity), and during severe blows. Further, the mechanism must be lightweight, inexpensive, and easily installed. Finally, the mechanism must work on all helmets, and force all pads to conform to the shape of the helmet.

A universal solution is to use a strap that runs over the outermost surface of the pad, and that anchors to existing features (or elements) of the helmet. Examples of such features include the facemask lattice (or other protrusions), holes through the helmet, and edges of the helmet. The securing straps can come in a variety of shapes and materials, such as netting that covers the entire outer surface of the pad, or ropes, or thin, flat, narrow belts that run down the centers of the pads. Such straps can be either separate components, or material permanently bonded to the pads. The flexible pads may be either planar-shaped planks (or pads), or curved planks whose shape roughly matches that of most helmets. The flexible pads may also be air-filled tubes or chambers (either connected or individual members), or structures composed of different materials. Finally, the anchoring devices may range from the strap itself, as in the case of self-anchoring Velcro® tapes, to special hooks that resemble present day fishing hooks (with a loop for the fishing line, but without the barb on the end). Anchoring devices may also range from small commercially-available clips and buckles, to small loops or brackets that are riveted or otherwise affixed to the helmet. Hard anchoring devices are acceptable provided they don't protrude appreciably from the shell, or are covered by soft material. Small buckles affixed to straps running down the center of a pad will be pushed down into compliant cushioning material (along with the rest of the strap), by the high tape tensile forces that indent the cushioning material.

BRIEF SUMMARY OF THE INVENTION

This invention consists of improving the effectiveness of protective headgear by attaching cushioning material (pads) to the outside of the headgear. The pads are substantially flat slabs that are anchored to the headgear by means of small clips and straps, preferably VELCRO® straps. The pads are made to conform to the helmet by pressure exerted by the straps, as they wrap around the curved helmet. Hence the apparatus can fit any helmet shape or size. The main pad is a strip that runs over the crown of the helmet, from front to back, making the helmet to resemble a "Mohawk" haircut. Side pads protect the sides of the helmet, and may abut against the Mohawk strip to form a cross, or run parallel to the Mohawk strip. The Mohawk strip may be used with or without the side pads. All apparatus can be repeatedly installed and removed entirely by hand.

DETAILED DESCRIPTION OF THE INVENTION

The present invention improves protective headgear by affixing cushioning (or pads) to the outside of the headgear. The cushioning elements may be pre-formed or substantially flat, flexible planks of material that are made conform to the headgear by the anchoring mechanism. The anchoring mechanism consists of straps and clips that attach to the helmet, and sandwich the pads between the straps and exterior surface of the helmet. The preferred embodiment of the strap is a narrow, thin VELCRO® wrap (or strap) with its opposite sides latched onto one another. Such self-latching VELCRO® straps minimize the number of discrete parts needed to anchor the pads to the helmet and reduce costs.

The principal pad is a strip that runs over the crown of the helmet from front to back. This makes the helmet resemble a Mohawk haircut, hence the term "Mohawk strip." The anchor points for the Mohawk strip are the facemask lattice in the front of the helmet and a small clip in the back. A longitudinal strap running down the middle of the Mohawk strip makes it conform to the helmet. The compressive force on the Mohawk pad (or strip) is due to the tensile force in the strap, acting around the curved surface of the helmet. Further, the Mohawk can be made to resist lateral movements, and keep the Mohawk strip centered on the helmet crown by running lateral straps through either existing helmet holes, or holes drilled expressly for this purpose. Alternately, lateral straps may be bonded to the top of the helmet, or anchored to features along the side of the helmet. Features like holes and bottom edges of the hard plastic shell may already exist, or be created for such anchoring purposes. The Mohawk strip, and the strap that runs along the top of the Mohawk strip, provide anchor points for the strap that holds the two side pads in place. The other anchor points for the side pads strap are detachable clips or hooks mounted on opposite sides of the helmet.

Figure 1:
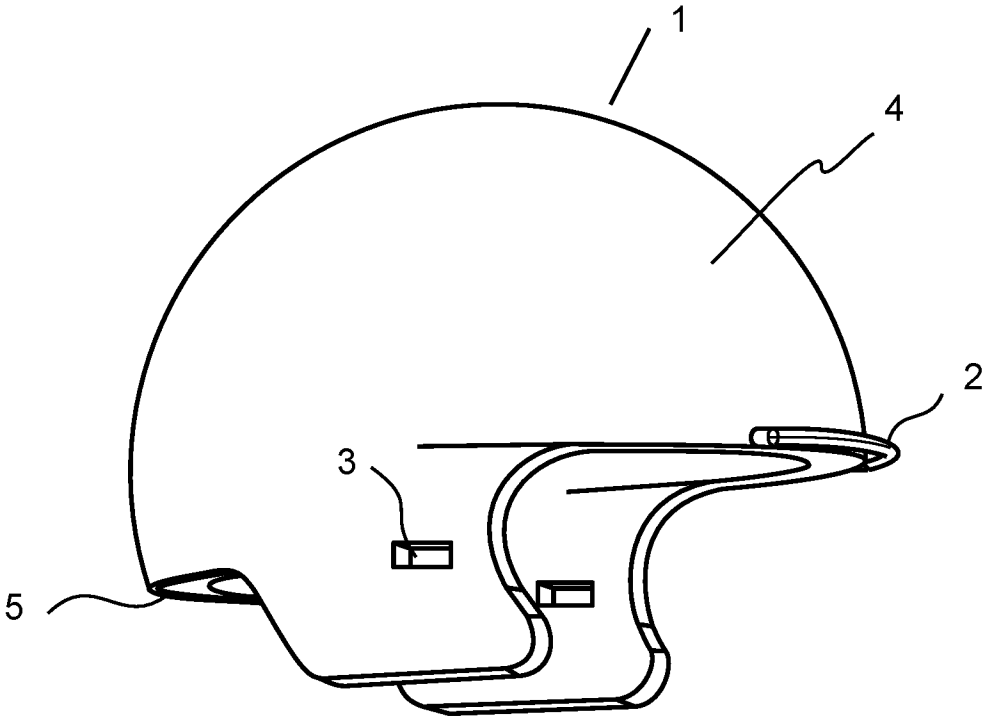
FIG. 1 shows a conventional football helmet.

FIG. 1 shows features of a conventional football helmet 1 that are most relevant to the present invention. Those features are the shell 4, a horizontal facemask lattice element 2, a vent hole 3, and the rearmost edge 5 of the shell 4. The lattice element 2, the vent hole 3, and rearmost edge 5 all provide built in anchor points for mounting components on the helmet shell 4. The shell 4 is typically made of hard plastic, and the lattice element 2 is usually made of steel and covered by a thin soft polymer or rubber.

Figure 2:
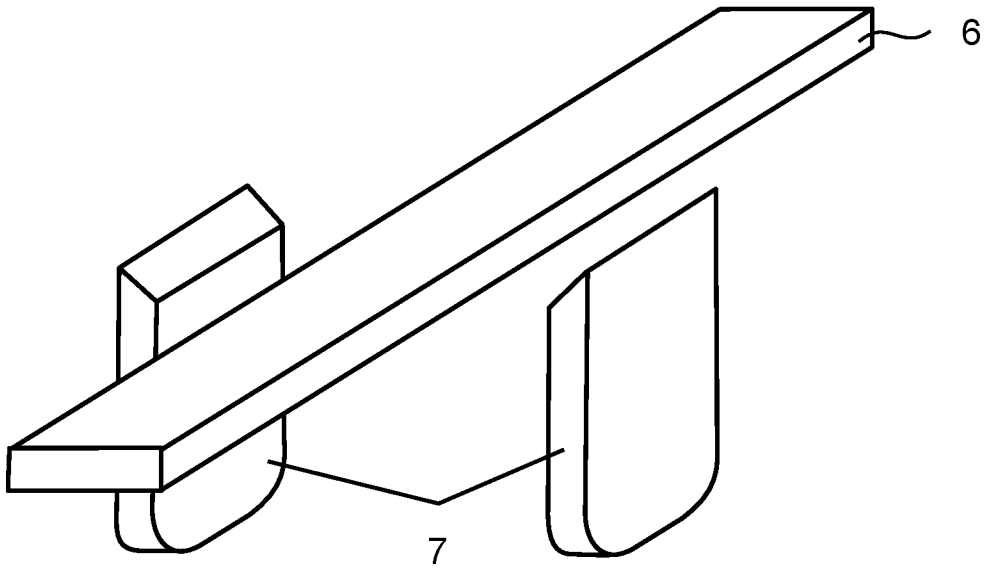
FIG. 2 shows planar, rectangular, flexible padding blocks in their straight, unstressed states.

FIG. 2 shows planar, rectangular, flexible padding in the form of planks, or blocks, in their straight, unstressed states. Such planks are the most economical form of cushioning material because they can be fabricated from simple molds, or extruded into-large flat slabs or rolls. The long plank is called a Mohawk strip 6, having dimensions in the range of four inches wide, by 15 inches long and one inch thick. The two vertically oriented planks are side strips 7 that protect the sides of the helmet. The side strips 7 may also be oriented horizontally. In an extreme case, two horizontal side strips 7 may be combined into just one continuous strip by wrapping them around the rear of the shell.

The flexible padding may also be made of air-filled polymer tubes, air-filled pads, or composite structures. In the case of air-filled tubes, multiple tubes may be fabricated as a unit, joined by webs, with the central web being wide enough to accommodate the strap that latches the padding to the helmet.

Figure 3:
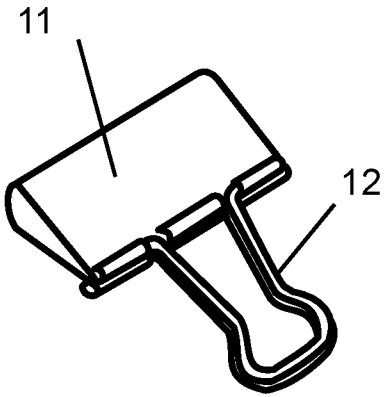
FIG. 3 shows clip-type anchor that can be used to attach a strap to the helmet shell.

FIG. 3 shows a clip 11 that can be used to anchor straps to shells. The clip 11 resembles a commercially-available paper clip, with the exception that its base is bent outward (instead of inward toward the detachable wings 12) to better conform to the edges of helmet shells (not shown). The detachable wings 12 provide loops for the straps (not shown). After attaching the clip 11 to the shell, one of the wings 12 may be removed.

Figure 4:
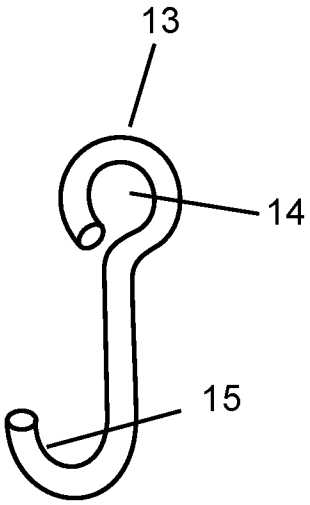
FIG. 4 shows a hook-type anchor that can be used to attach a strap to the helmet shell.

FIG. 4 shows a hook 13 that can be used to attach straps to shells. The hook 13 resembles a small fishing hook, including a loop for the strap, but without a barb on its end.

In general, anchoring devices must be small yet very strong. As such, hardened metal is typically preferred over plastic. However, anchoring devices may range from the strap itself, as in the case of self-anchoring VELCRO® tapes, to devices customized for particular helmet designs. For example, the self-anchoring VELCRO® strap may be attached to a facemask lattice by being wrapped around the lattice, then twisted about its longitudinal axis so that its latching surfaces match up and are then pressed together. Anchoring devices may also include buckles or brackets that are riveted or otherwise affixed to the helmet. Hard anchoring devices are acceptable, provided they don't protrude appreciably from the shell, or are covered by soft material. Small buckles affixed to straps running down the center of a pad will be pushed down into compliant cushioning material (along with the rest of the strap) by the high tape tensile forces that indent the cushioning material.

The simplest anchoring device is a patch of glue that bonds the end of strap to some point on the shell. However, this approach suffers the disadvantages of being permanent, and the variable bond strength inherent with glues, especially under environmental extremes and high impact loads.

Figure 5:
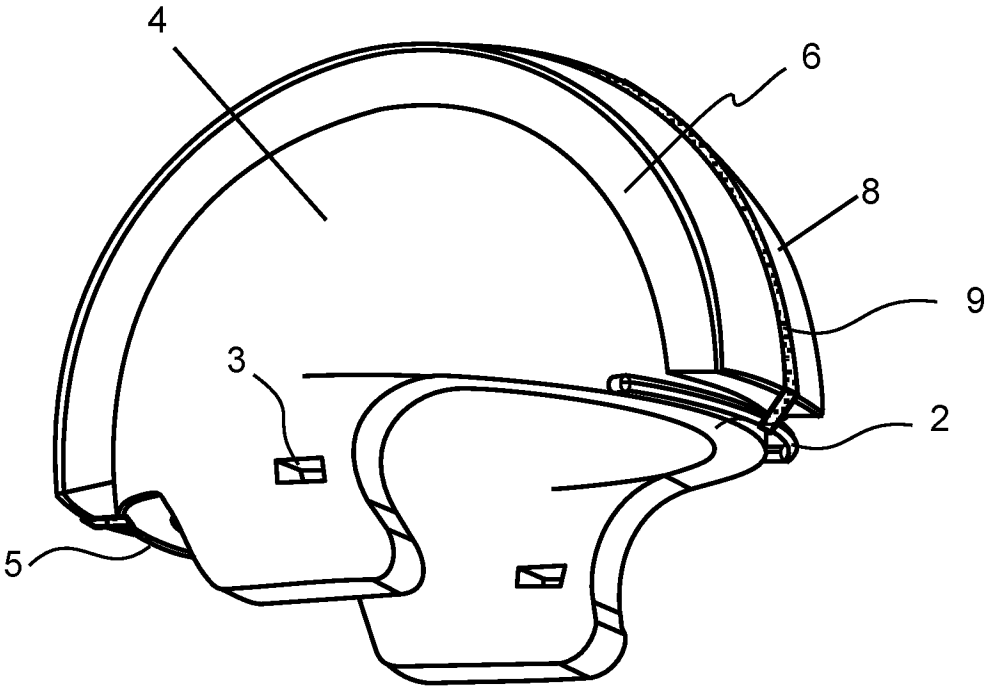
FIG. 5 shows a Mohawk strip mounted on the crown of a helmet, and held in place by means of a strap.

FIG. 5 shows a Mohawk strip 6 mounted on the crown of a helmet 4, and held in place by means of a strap 9. The strap 9 is anchored in the front to the facemask lattice 2, and in the back to the rearmost edge 5 of the shell 4, using either a clip or hook anchor, not shown. The Mohawk 6 depicted in FIG. 5 possesses a flexible protective skin 8 designed to resist gouging In some cases it may be advantageous to run the strap 9 completely around the Mohawk strip 6, which allows you to terminate the ends of the strap upon themselves, at the top of the Mohawk strip 6, for example. Doing this simplifies the anchoring points. For example, the strap could be simply wrapped around the facemask lattice at the front and looped through a hole drilled at the rear edge 5 at the back. Only the ends of the strap need to be made of VELCRO® material, thereby savings costs. The ends could alternatively be joined by a small high-strength buckle, not shown.

The strap 9 can be implemented in various geometries and materials. For example, a net-type strap 9 could cover the entire Mohawk strip 6, thereby applying more uniform pressure over the surface of the Mohawk strip 6, thereby making it better conform to the shape of the shell 4, especially along the outer edges of the Mohawk strip 6. Materials such as ballistic nylon and KEVLAR® strands can be construct high strength, abrasion resistance nets and flat straps 9.

Figure 6:
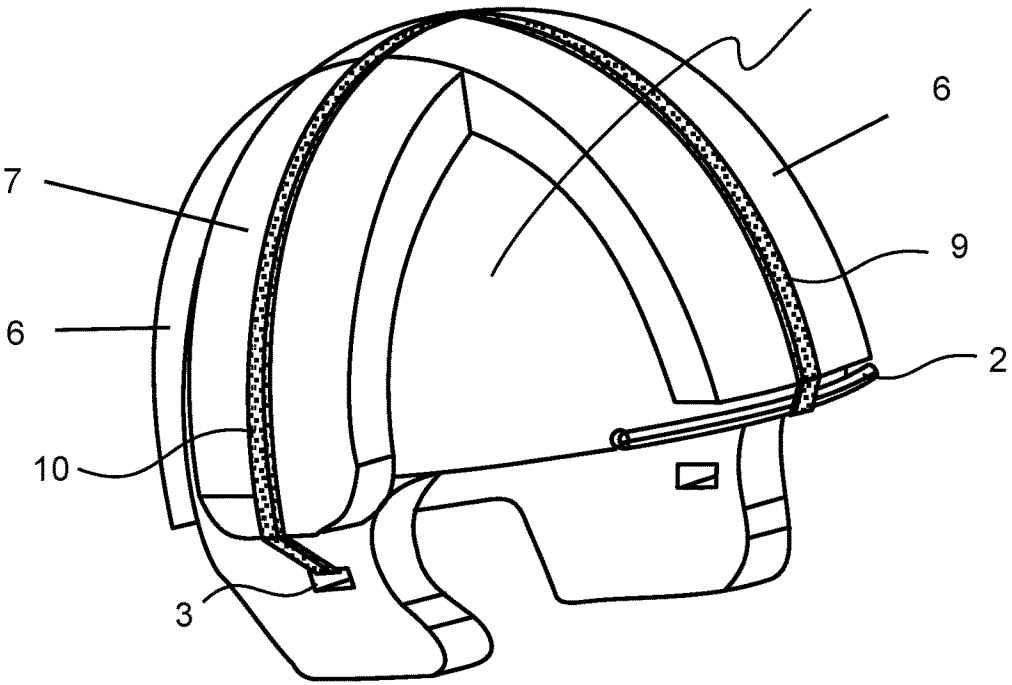
FIG. 6 shows a helmet with both a Mohawk strip and side cushions attached.

FIG. 6 shows a helmet with both a Mohawk strip 6 and side strips 7 attached. The side strips 7 are latched to the shell 4 by means of their own lateral strap 10. The lateral strap 10 will usually anchor onto features on the side of the shell 4, such as vents 3, and to the Mohawk strip 9 at the top of the shell 4. However, when the side strips 7 are oriented horizontally, the lateral strap 10 will also be oriented horizontally and anchored to convenient points such as the facemask lattice 2 and the rearmost segment of the Mohawk strip 9. Laterally oriented side strips 7 may be held in place vertically by cross straps (not shown) that weave through lateral holes in the shell 4 like the vent 3.

Numerous modifications to and alternative embodiments of the present invention will be apparent to those skilled in the art in view of the foregoing description. Accordingly, this description is to be construed as illustrative only, and is for the purpose of teaching those skilled in the art the best modes of carrying out the invention. Details of the system may be varied substantially without departing from the spirit of the invention and the exclusive use of all modifications which come within the scope of the appended claims is reserved.

What we claim as our invention is:

1. A protective headgear for reducing the severity of blows to the head of a user, said protective headgear consists of a hard outer shell covered with an elongated linear rectangular-shaped strip of cushioning material disposed onto the crown portion so that the elongated linear rectangular-shaped strip of cushioning material is arranged on the hard outer shell in a central location from a front to a rear of the outside of the hard outer shell;

at least one linear side strip of cushioning material disposed on the outside of the hard outer shell at a location to the right and/or left of the elongated linear rectangular-shaped strip of cushioning material, wherein the at least one linear side strip of cushioning material has rounded bottom corners and a tapered upper edge that abuts a side of the elongated linear rectangular-shaped strip of cushioning material;

a crown strap comprising hooks and/or clips placed over the elongated linear rectangular-shaped strip of cushioning material so that the crown strap secures the elongated linear rectangular-shaped strip of cushioning material onto the hard outer shell from the front to the rear of the hard outer shell, thereby sandwiching the elongated linear rectangular-shaped strip of cushioning material between the crown strap and the hard outer shell along the central location;

a side strap comprising hooks and/or clips placed over the at least one linear side strip of cushioning material to secure the at least one linear side strip of cushioning material onto the hard outer shell, thereby making the linear side strip of cushioning material sandwiched between the side strap and the hard outer shell at the location to the right and/or left of the elongated linear rectangular-shaped strip of cushioning material; and wherein the crown strap is attached over the elongated linear rectangular-shaped strip of cushioning material onto anchor points of the hard outer shell and the side strap is attached over the elongated linear rectangular-shaped strip of cushioning material and the at least one linear side strip of cushioning material onto the anchor points of the hard outer shell which forces the elongated linear rectangular-shaped strip of cushioning material and the at least one linear side strip of cushioning material to conform to the hard outer shell.

2. A method for forming a protective headgear comprising:

attaching an elongated linear rectangular-shaped strip of cushioning material onto the crown portion of a hard outer shell so that the elongated linear rectangular-shaped strip of cushioning material is arranged on the hard outer shell in a central location from a front to a rear on the outside of the hard outer shell;

attaching at least one linear side strip of cushioning material on the outside of the hard outer shell at a location to the right and/or left of the elongated linear rectangular-shaped strip of cushioning material, wherein the at least one linear side strip of cushioning material has rounded bottom corners and a tapered upper edge that abuts a side of the elongated rectangular-shaped strip of cushioning material;

attaching a crown strap comprising hooks and/or clips over the elongated linear rectangular-shaped strip of cushioning material so that the crown strap secures the elongated linear rectangular-shaped strip of cushioning material onto the hard outer shell from the front to the rear of the hard outer shell, thereby sandwiching the elongated linear rectangular-shaped strip of cushioning material between the crown strap and the hard outer shell along the central location;

attaching a side strap comprising hooks and/or clips over the at least one linear side strip of cushioning material to secure the at least one linear side strip of cushioning material onto the hard outer shell, thereby making the at least one linear side strip of cushioning material sandwiched between the side strap and the hard outer shell at the location to the right and/or left of the elongated linear rectangular-shaped strip of cushioning material; and wherein the attaching of the crown strap over the elongated linear rectangular-shaped strip of cushioning material onto anchor points of the hard outer shell, and the side strap over the elongated linear rectangular-shaped strip of cushioning material and the at least one linear side strip of cushioning material onto the anchor points of the hard outer shell, forces the elongated linear rectangular-shaped strip of cushioning material and the at least one linear side strip of cushioning material to conform to the hard outer shell.

* * * * *